US011548540B2

(12) United States Patent
Tokumaru

(10) Patent No.: US 11,548,540 B2
(45) Date of Patent: Jan. 10, 2023

(54) TRAIN CONTROL SYSTEM, GROUND CONTROL APPARATUS, AND ON-BOARD CONTROL APPARATUS

(71) Applicant: Mitsubishi Electric Corporation, Tokyo (JP)

(72) Inventor: Makoto Tokumaru, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 819 days.

(21) Appl. No.: 16/466,850

(22) PCT Filed: Dec. 13, 2016

(86) PCT No.: PCT/JP2016/087026
§ 371 (c)(1),
(2) Date: Jun. 5, 2019

(87) PCT Pub. No.: WO2018/109830
PCT Pub. Date: Jun. 21, 2018

(65) Prior Publication Data

US 2019/0315382 A1 Oct. 17, 2019

(51) Int. Cl.
*B61L 15/00* (2006.01)
*B61L 3/12* (2006.01)
*B61L 25/02* (2006.01)

(52) U.S. Cl.
CPC ..... *B61L 3/12* (2013.01); *B61L 15/0018* (2013.01); *B61L 25/021* (2013.01); *B61L 2205/04* (2013.01)

(58) Field of Classification Search
None
See application file for complete search history.

(56) References Cited

U.S. PATENT DOCUMENTS 8,985,524 B2 3/2015 Takahashi et al.
2005/0133673 A1* 6/2005 Sugita ..... B61L 27/40 246/167 R (Continued)

FOREIGN PATENT DOCUMENTS

CA 2850488 C 5/2018
GB 2480568 A 11/2011
JP 2013075643 A 4/2013

OTHER PUBLICATIONS

Office Action dated Apr. 22, 2021, for the corresponding German Patent Application No. 112016007518.9, 16 pages including 8 pages of English translation.

(Continued)

*Primary Examiner* — James M McPherson
(74) *Attorney, Agent, or Firm* — Buchanan Ingersoll & Rooney PC

(57) ABSTRACT

The present invention includes an on-board control apparatus that generates train position information using ground coil position information and train speed information and outputs the train position information, and a ground control apparatus that receives the train position information outputted by the on-board control apparatus, identifies a position of a train using the train position information and stored track information, generates train control data having a size corresponding to the identified position of the train, and outputs the train control data toward the train.

10 Claims, 13 Drawing Sheets

(56) References Cited

U.S. PATENT DOCUMENTS

| | | | | |
|---|---|---|---|---|
| 2014/0209761 | A1 | 7/2014 | Kurita | |
| 2015/0360706 | A1* | 12/2015 | Niinomi | B61L 27/12 701/19 |

OTHER PUBLICATIONS

Office Action dated Dec. 22, 2020 for corresponding Indian patent Application No. 201947020665, 6 pages.
International Search Report (with English translation) and Written Opinion issued in corresponding International Patent Application No. PCT/JP2016/087026, 12 pages (Mar. 14, 2017).

* cited by examiner

TRAIN CONTROL SYSTEM, GROUND CONTROL APPARATUS, AND ON-BOARD CONTROL APPARATUS

FIELD

The present invention relates to a train control system using radio.

BACKGROUND

In a conventional train control system using radio, an on-board control apparatus carried on a train detects a position and a speed of the train and transmits information on the position and speed of the train to a ground control apparatus using radio. The ground control apparatus that manages trains present in an area covered thereby performs calculation on the basis of the received information on a position and a speed of a train and sets a stop limit position of the following train. The ground control apparatus transmits information on the set stop limit position to the on-board control apparatus of the train in question using radio. Thus, train control is performed while securing a safe interval between trains by performing communication between the on-board control apparatus and the ground control apparatus by radio (see, for example, Patent Literature 1).

CITATION LIST

Patent Literature

Patent Literature 1: Japanese Patent Application Laid-open No. 2013-75643

SUMMARY

Technical Problem

Generally, for a train traveling at high speed in an area middle between one station and another station adjacent thereto (inter-station area), a train interval to a next train is set large in order to secure a safe train interval. For this reason, the number of trains to be managed in the inter-station area is small. On the other hand, the number of trains to be managed near a railway yard (railway yard area) is relatively large.

However, in the conventional train control system using radio, the size of data generated by each of the on-board control apparatus and the ground control apparatus has been already determined. Furthermore, a communication band that can be used by a wireless base station is limited, so that the number of trains with which one wireless base station can communicate per unit time is limited, and in a railway yard area where a large number of trains are present, for example, one wireless base station cannot communicate with all of the trains, and the number of wireless base stations must be increased, which has been problematic.

The present invention has been made in order to solve the above problem, and an object thereof is to increase the number of trains with which one wireless base station can communicate per unit time.

Solution to Problem

A train control system of a first invention comprises: an on-board control apparatus to generate train position information using ground coil position information and train speed information and to output the train position information; and a ground control apparatus to receive the train position information outputted by the on-board control apparatus, to identify a position of a train using the train position information and stored track information, to generate train control data having a size corresponding to the identified position of the train, and to output the train control data toward the train.

A ground control apparatus of a second invention receives train position information outputted from an on-board control apparatus mounted on a train, identifies a position of the train using the train position information and stored track information, generates train control data having a size corresponding to the identified position of the train, and outputs the train control data toward the train.

An on-board control apparatus of a third invention is mounted on a train, identifies a position of the train using ground coil position information and train speed information, generates train position information having a size corresponding to the identified position of the train, and outputs the train position information to a ground control apparatus that controls an operation of the train.

Advantageous Effects of Invention

A train control system according to the present invention includes an on-board control apparatus that generates train position information using ground coil position information and train speed information and outputs the train position information, and a ground control apparatus that receives the train position information outputted by the on-board control apparatus, identifies a position of a train using this train position information and stored track information, generates train control data having a size corresponding to the identified position of the train, and outputs this train control data toward the train, whereby the number of trains with which one wireless base station can communicate per unit time can be increased.

The ground control apparatus according to the present invention identifies a position of a train using train position information outputted by the on-board control apparatus and track information stored in the ground control apparatus, and generates train control data having a size corresponding to the identified position of the train, and thereby the number of trains with which one wireless base station can communicate per unit time can be increased.

The on-board control apparatus according to the present invention is mounted on a train, identifies a position of the train using ground coil position information and train speed information, generates train position information having a size corresponding to the identified position of the train, and outputs this train position information to a ground control apparatus that controls an operation of the train, thereby making it possible to increase the number of trains with which one wireless base station can communicate per unit time.

DESCRIPTION OF EMBODIMENTS

First Embodiment

Figure 1:
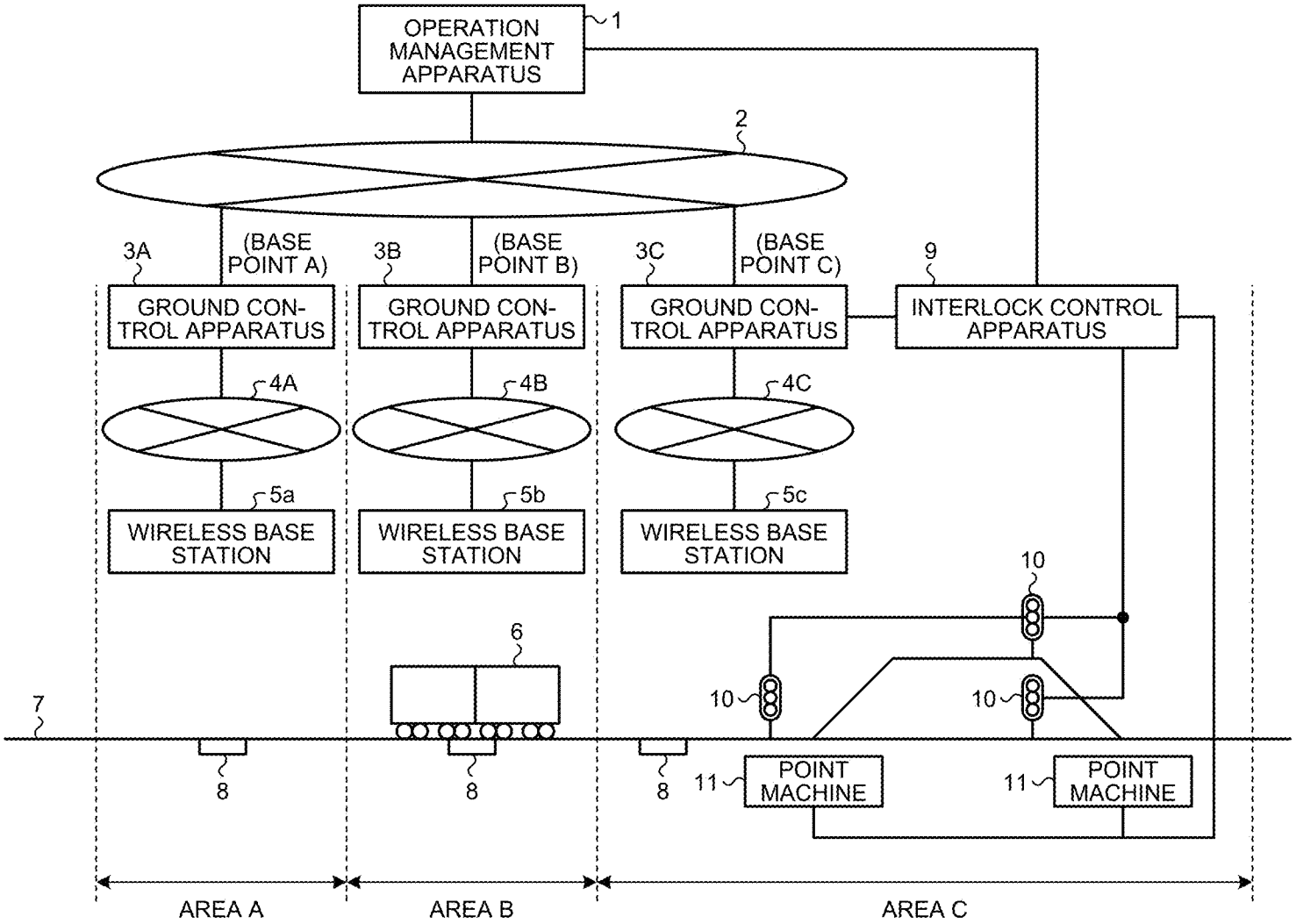
FIG. 1 is a diagram illustrating a schematic configuration of a train control system according to a first embodiment.

FIG. 1 is a configuration diagram of a train control system according to a first embodiment of the present invention. The train control system illustrated in FIG. 1 is configured to include an operation management apparatus 1, a plurality of ground control apparatuses 3A to 3C (hereinafter referred to as ground control apparatuses 3 when not limited to a particular ground control apparatus) connected to the operation management apparatus 1 via a train control system network 2, a plurality of wireless base stations 5*a* to 5*c* (hereinafter referred to as wireless base stations 5 when not limited to a particular wireless base station) connected to the ground control apparatuses 3 via base point networks 4A to 4C (hereinafter referred to as base point networks 4 when not limited to a particular base point network), an on-board wireless apparatus 62 (details thereof will be described later) mounted on a train 6, and an on-board control apparatus 68 (details thereof will be described later) mounted on the train 6.

The train control system is configured such that a track 7 is divided into multiple control areas (for example, areas corresponding to three base points A to C), the ground control apparatus 3 is provided to each base point, and the ground control apparatus 3 controls the train 6 in each control area. For example, each area delimited by a broken line in FIG. 1 represents an area managed by one of the ground control apparatuses 3.

The operation management apparatus 1 performs monitoring operation conditions and changing settings for the entire train control system, and the like. For example, the operation management apparatus 1 performs setting of temporary speed limitation, instruction to an interlock control apparatus 9 to perform route control, and the like.

The train control system network 2 is a network in the entire wireless train control section and connects the operation management apparatus 1 and the ground control apparatuses 3.

One ground control apparatus 3 is provided in each area. The ground control apparatus 3 receives train position information from the train 6 via the wireless base station 5 and the base point network 4, recognizes a position of each train 6 from the received train position information, and transmits the information via the train control system network 2 to the operation management apparatus 1, and further to the interlock control apparatus 9. In FIG. 1, the interlock control apparatus 9, point machines 11, and signal devices 10 are placed in the area C. However, some or all of these components may be placed in other areas.

The interlock control apparatus 9 controls the point machines 11 and the signal devices 10 on the basis of the train position information from the ground control apparatus 3 and a route control instruction from the operation management apparatus 1. In addition, the interlock control apparatus 9 transmits route opening information related to go and stop of the train 6 to the ground control apparatus 3.

On the basis of the train position information and the route opening information from the interlock control apparatus 9, the ground control apparatus 3 calculates a stop limit position (a limit position where the train 6 should be stopped) of each train 6 present in the area. The ground control apparatus 3 transmits information on the calculated stop limit position to the on-board control apparatus 68 via the wireless base station 5 and the on-board wireless apparatus 62.

Here, the stop limit position information is information that, on the basis of a position of a preceding train or a position where the train is to be stopped, indicates, to a following train, a limit position where the train can be safely stopped.

The base point network 4 is a network provided for each area and connects the ground control apparatus 3 and the wireless base station 5.

The track 7 is a structure on a roadbed along which the train 6 travels. The operation of the train 6 is controlled by the train control system illustrated in FIG. 1. On the track 7, multiple ground coils 8 (or position correcting ground coils 8) for which IDs (ground coil information) are set are installed at intervals. FIG. 1 illustrates an example in which one ground coil 8 is installed in each area, but the invention is not limited to this example, and a plurality of ground coils 8 may be installed in an area.

The wireless base station 5 communicates with the on-board wireless apparatus 62 in an on-board apparatus 61 equipped in the train 6. In FIG. 1, only one wireless base station 5 is disposed in each area, but a plurality of wireless base stations 5 may be disposed in each area.

Figure 2:
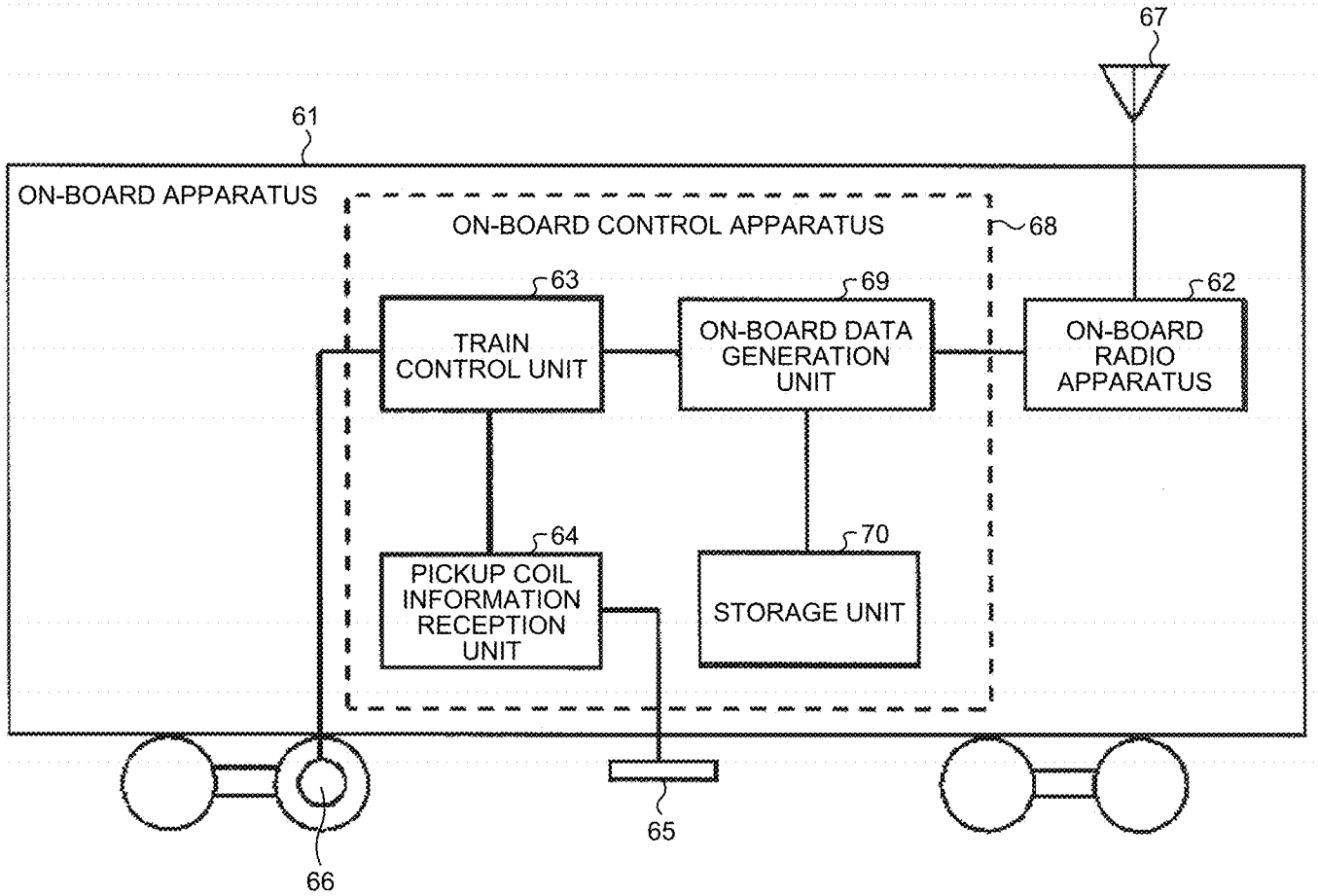
FIG. 2 is a diagram illustrating a configuration of a vehicle according to the first embodiment.

FIG. 2 is a diagram illustrating a configuration of a vehicle of the train 6 traveling in the train control system according to the first embodiment. FIG. 2 illustrates only devices required for describing the train control system according to the first embodiment only, but other devices and functions may be mounted.

The vehicle illustrated in FIG. 2 includes the on-board apparatus 61, a pickup coil 65, a tacho-generator 66, and an on-board antenna 67. Inside the on-board apparatus 61, the on-board radio apparatus 62 and the on-board control apparatus 68 are provided. The on-board control apparatus 68 includes a train control unit 63, a pickup coil information reception unit 64, an on-board data generation unit 69 (details thereof will be described later), and a storage unit 70.

An on-board database (not illustrated) is stored in the storage unit 70. Information (track information) on the track 7 on which the train 6 travels is stored in the on-board database. The information on the track 7 includes position information indicating which area each ground control apparatus 3 manages and installation kilometrage information (installation position information) on the ground coils 8.

The on-board radio apparatus 62 communicates with the wireless base station 5 corresponding to a present position of the train 6 that includes the on-board wireless apparatus 62.

The pickup coil 65 detects an ID of the ground coil 8 when passing over the ground coil 8 (when the pickup coil 65 and the ground coil 8 overlap). The ID is received by the pickup coil information reception unit 64 as pickup coil information. The pickup coil information is outputted from the pickup coil information reception unit 64 to the train control unit 63.

The train control unit 63 detects a position of the ground coil 8 by the pickup coil information from the pickup coil information reception unit 64, and sets the position of the ground coil 8 as a reference position. Then, the train control unit 63 counts the number of pulses generated by power generation of the tacho-generator 66, and calculates a travel distance using a wheel diameter and the number of power generation pulses per revolution. An absolute position of the train 6 including the train control unit 63 on the track 7 is determined by combining the reference position and the calculated travel distance.

An error may occur in the travel distance calculated from the tacho-generator 66 for a reason of idle running or slide running. Therefore, the position correcting ground coils 8 are arranged on the track 7. When the pickup coil 65 passes over the position correcting ground coil 8 (when the pickup coil 65 and the position correcting ground coil 8 overlap with each other), the pickup coil 65 detects an ID of the position correcting ground coil 8 and sets the detected position of the position correcting ground coil 8 as a second reference position. When the absolute position and the second reference position are different from each other, that is, when there is an error between the absolute position and the second reference position, the absolute position is reset, a new absolute position is calculated from the second reference position, and the position of the train 6 is corrected. The correction of the position of the train 6 is not limited to the above-mentioned method, and in a case where a global positioning system (GPS) apparatus is equipped, information obtained from the GPS may be used.

The on-board data generation unit 69 generates on-board data including the information (train position information) on the position of the train 6 including the on-board data generation unit 69, which is calculated as described above. Details thereof will be described later.

The on-board control apparatus 68 transmits on-board data including train position information to the ground control apparatus 3 via the on-board radio apparatus 62 and the wireless base station 5.

A basic operation of the train control system will be described below. The on-board data including the train position information is generated by the on-board data generation unit 69, then outputted to the on-board radio apparatus 62, and set in a predetermined transmission frame. Then, this transmission frame is transmitted to the ground control apparatus 3 managing the train 6 in question via the wireless base station 5.

Each ground control apparatus 3 detects the position of the train 6 traveling in an area the ground control apparatus 3 manages, exchanges position information with another ground control apparatus 3, and generates stop limit position information on the basis of these pieces of position information. The generated stop limit position information is transmitted to the wireless base station 5. The wireless base station 5 sets the information in a predetermined transmission frame and transmits the transmission frame as train control data to the on-board radio apparatus 62.

In each ground control apparatus 3, on-track management information is generated which indicates where the train 6 present in the base point is located on the track, and this information is transmitted to the operation management apparatus 1. The operation management apparatus 1 recognizes the positions of all the trains in the system on the basis of the on-track management information from each of the ground control apparatuses 3.

In the on-board wireless apparatus 62 receiving the transmission frame (train control data) from the wireless base station 5, the stop limit position information is extracted, and the extracted stop limit position information is transmitted to the train control unit 63. The train control unit 63 generates a speed check pattern on the basis of the stop limit position information. The speed check pattern is a train operation curve of which the horizontal axis represents distance (position) and the vertical axis represents speed. The train control unit 63 compares train speed information detected by the tacho-generator 66 with the generated speed check pattern. When the train speed information exceeds the speed check pattern, specifically, when a train speed at a certain position is higher than a speed represented by the speed check pattern, a brake command is generated in the train control unit 63, and the brake command is transmitted to a brake control apparatus (not illustrated). For example, when the train 6 illustrated in FIG. 1 approaches a preceding train (not illustrated), the train speed information exceeds the speed check pattern, and therefore, a brake is automatically applied by the brake control apparatus. In this way, according to the train control system of the first embodiment, it is possible to control the operation of trains at appropriate train intervals, so that a transportation efficiency can be improved.

Figure 3:
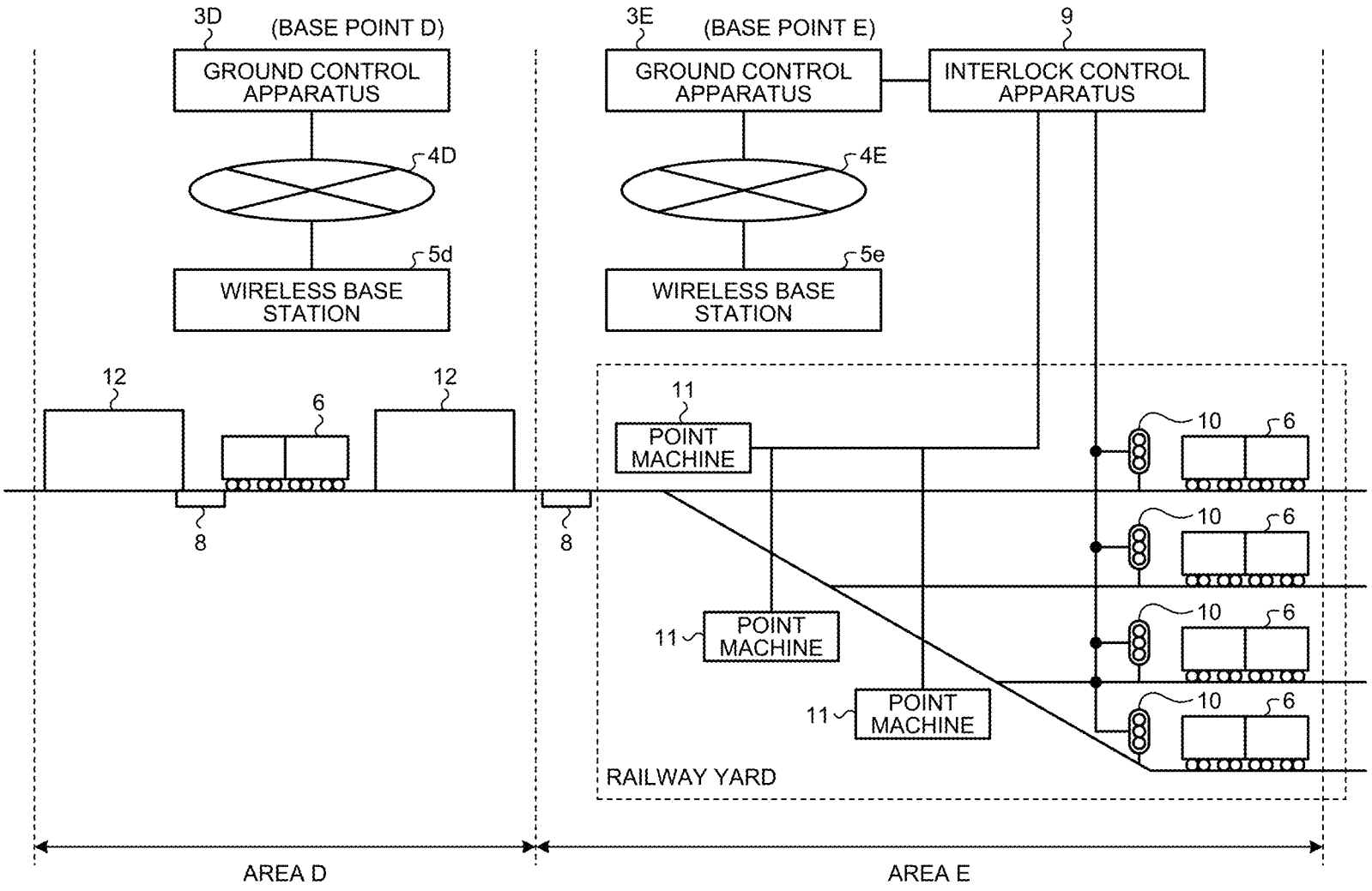
FIG. 3 is a diagram illustrating a schematic configuration of the train control system according to the first embodiment.

FIG. 3 is an example of a configuration diagram of the train control system according to the first embodiment around a railway yard area. In the train control system, the ground control apparatus 3 is provided to each of base points D and E, and each ground control apparatus 3 is configured to manage the train 6 or trains 6 in the corresponding base point. For example, areas delimited by broken lines in FIG. 3 each indicate an area managed by the corresponding ground control apparatus 3.

A ground control apparatus 3D manages the train 6 present on a track in an area D that includes no railway yard. A ground control apparatus 3E manages the trains 6 present on tracks in an area E that includes a railway yard. Because the area D managed by the ground control apparatus 3D is an area that includes two or more stations 12, the area D is wider than the area E managed by the ground control apparatus 3E.

Because the area E covers the railway yard, the number of trains 6 present on tracks therein is larger than the number of the trains 6 present on a track in the area D. That is, the ground control apparatus 3E manages many trains 6 present on tracks in the narrow area. Here, the number of trains 6 that are present on tracks in the area managed by the ground control apparatus 3 and communicate with the ground control apparatus 3 per unit time is defined as train density, and a case where the train density is equal to or larger than a predetermined reference value is expressed as "train density is high". On the other hand, a case where the train density is less than the predetermined reference value is expressed as "normal". As the predetermined reference value, for example, the maximum number of trains with which one wireless base station 5 can communicate per unit time is set.

A wireless base station 5*e* communicates with more trains 6 than a wireless base station 5*d*. When the trains 6 sequentially depart from the railway yard, for example, in morning commuting rush hours, the number of trains 6 with which the wireless base station 5*e* communicates per unit time is significantly increased. If the wireless base stations 5 have their equal specifications, the number of trains 6 with which one wireless base station 5 can communicate is fixed. For this reason, it has conventionally been necessary to take a measure such as increasing the number of the wireless base stations 5 in a place where a large number of trains 6 are present, such as the area E.

Next, an operation of the on-board data generation unit 69 of the on-board control apparatus 68 used in the train control system according to the first embodiment will be described.

Figure 4:
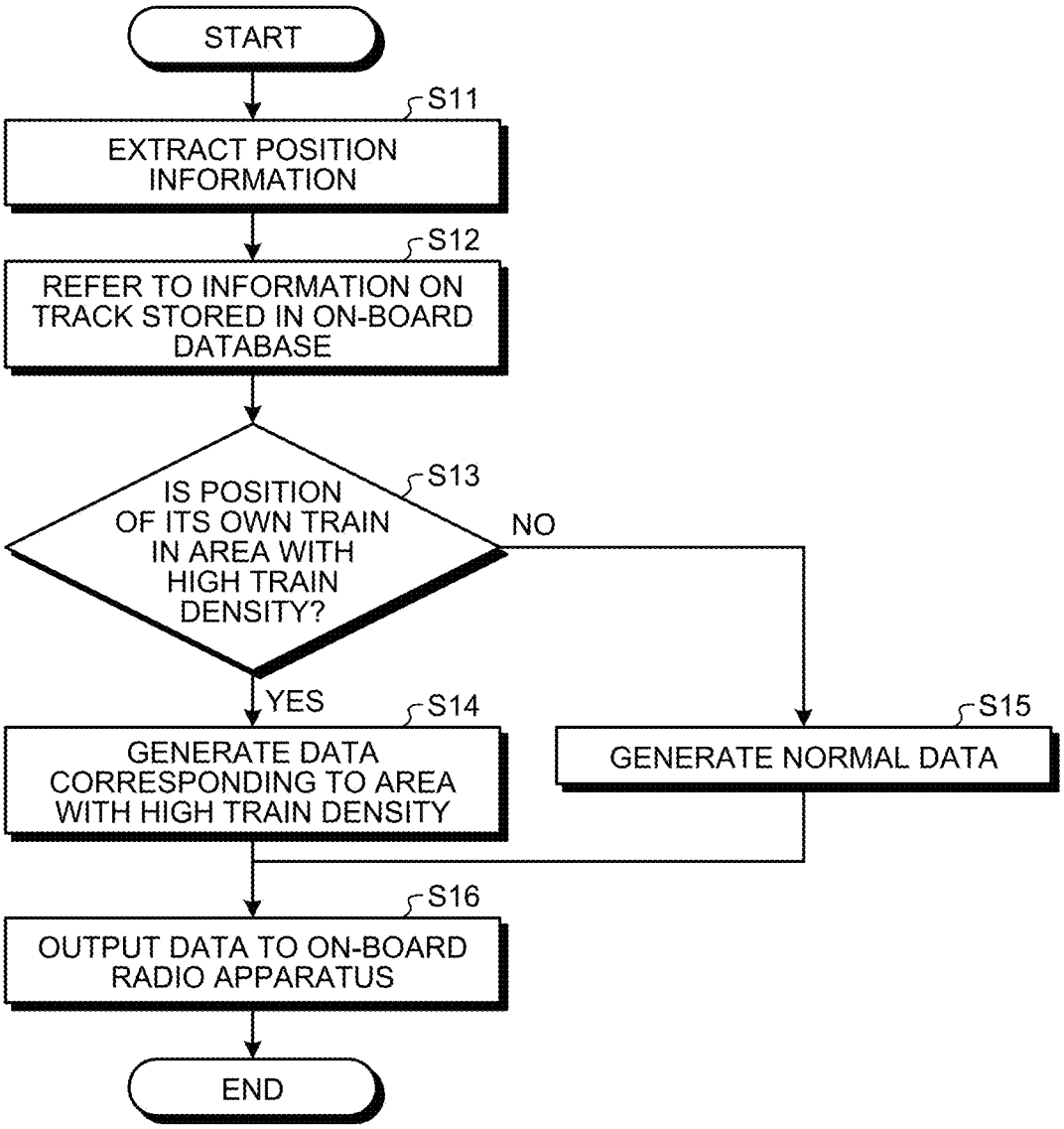
FIG. 4 is a flowchart illustrating an operation of an on-board control apparatus according to the first embodiment.

FIG. 4 is a flowchart illustrating the operation of the on-board data generation unit 69 included in the on-board control apparatus 68 according to the first embodiment. First, position information (train position information) is extracted from information outputted from the train control unit 63 (S11). Next, information (track information) on the track 7, stored in the on-board database, is referred to (S12). It is determined from the extracted position information whether or not the train 6 including the on-board data generation unit 69 is present on a track in an area with high train density (S13). In a case where the train 6 is present on a track in an area with high train density such as the area E in FIG. 3 (S13: Yes), on-board data having a data size corresponding to the area with high train density is generated (S14). In a case where the train 6 is present on a track in a normal area such as the area D in FIG. 3 (S13: No), on-board data having a normal data size is generated (S15). The on-board data generated in S13 or S14 is outputted to the on-board radio apparatus 62 to be outputted toward the ground control apparatus 3 (S16).

For example, in a normal area such as the area D, on-board data having a normal data size is outputted to the on-board radio apparatus 62. On the other hand, in an area with high train density such as the area E, the data size of the on-board data is reduced to be smaller than the normal size and then the on-board data is outputted to the on-board radio apparatus 62.

By making the data size of the on-board data transmitted from one train 6 small, more room can be given to a frequency band in which one wireless base station 5 can perform communication per unit time. Accordingly, it is possible for one wireless base station 5 to communicate with more trains 6 than usual.

Figure 5A:
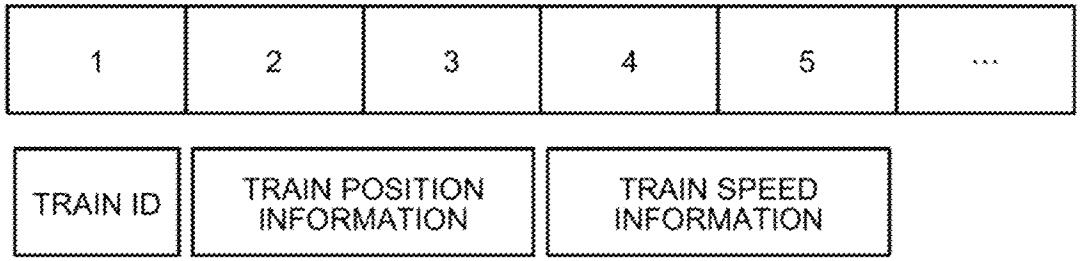
FIG. 5A is a diagram illustrating an example of a data format of data generated by the on-board control apparatus according to the first embodiment.
Figure 5B:
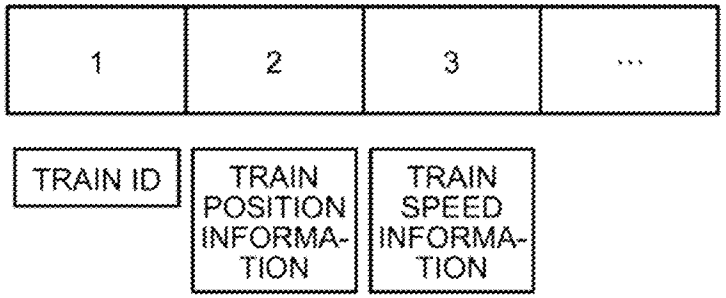
FIG. 5B is a diagram illustrating an example of a data format of data generated by the on-board control apparatus according to the first embodiment.

FIGS. 5A and 5B are diagrams illustrating an example of a data format of on-board data generated by the on-board control apparatus 68 according to the first embodiment. This example is based on the assumption that the data illustrated in FIGS. 5A and 5B is managed in units of 8 bits (1 byte). FIG. 5A is an example of on-board data in a normal area, and FIG. 5B is an example of on-board data in an area with high train density. On-board data generated by the on-board control apparatus 68 includes device identification information (train ID, for example), train position information, and train speed information. As illustrated in FIG. 5A, in the normal area, the on-board control apparatus 68 generates on-board data of 40 bits in total including the train ID of 8 bits, the train position information of 16 bits, and the train speed information of 16 bits. As illustrated in FIG. 5B, in the area with high train density, the on-board control apparatus 68 generates on-board data of 24 bits in total including the train ID of 8 bits, the train position information of 8 bits, and the train speed information of 8 bits.

The data sizes of the train position information and the train speed information of the on-board data of FIG. 5B are small in comparison with those of the on-board data of FIG. 5A. In other words, it is possible to make the data sizes of the train position information and the train speed information in the area with high train density to be smaller than those in the normal area.

The train position information will be described. A range managed by the ground control apparatus 3 is wider in the normal area than in the area with high train density. For example, when a range of 10 km is managed, the range is managed with division into blocks. If a range of 200 m is managed for one block, 50 blocks are required for managing the entire range of 10 km. In addition, when considering up-train and down-train, twice as many as the blocks, i.e., 100 blocks are required. In contrast, the range managed by the ground control apparatus 3 is narrower in the area with high train density than in the normal area. For example, if a range of 1 km around a railway yard including a plurality of storage tracks is divided into blocks to be managed similarly to the case of the normal area, the number of blocks required for managing the range may be 50 or less. Since the range managed by the ground control apparatus 3 is narrower in the area with high train density than in the normal area, it is possible to reduce the number of blocks managed by the ground control apparatus 3 and to reduce a size of data for the management in the area with high train density.

The train speed information will be described. A maximum speed of the train 6 is different between a normal area and an area with high train density such as a railway yard or a station yard of a large station. For example, in many cases, the maximum speed in the normal area is 100 km/h, whereas the maximum speed in the area with high train density such as a railway yard or a station yard of a large station is 20 km/h. In a case where a resolution of speed management is the same value of 0.1 km/h, a size of data for the management in the area with high train density such as a railway yard or a station yard of a large station can be allowed to be made smaller because the maximum speed is smaller in the area with high train density than in the normal area.

The on-board data illustrated in FIG. FIGS. 5A and 5B is set in a transmission frame in the on-board radio apparatus 62 and transmitted to the ground control apparatus 3 via the wireless base station 5.

As described above, the on-board data generation unit 69 included in the on-board control apparatus 68 according to the first embodiment identifies the position of the train 6 including the on-board data generation unit 69 from the extracted train position information, and determines in which area that train 6 is present on a track. That is, the on-board data generation unit 69 determines which ground control apparatus 3 manages the area in which the train 6 is present on a track. After making the determination, the on-board control apparatus 68 generates on-board data including the train position information as on-board data corresponding to the area determined to be an area in which the train 6 is present on a track, and transmits the on-board data to the on-board wireless apparatus 62.

Figure 6:
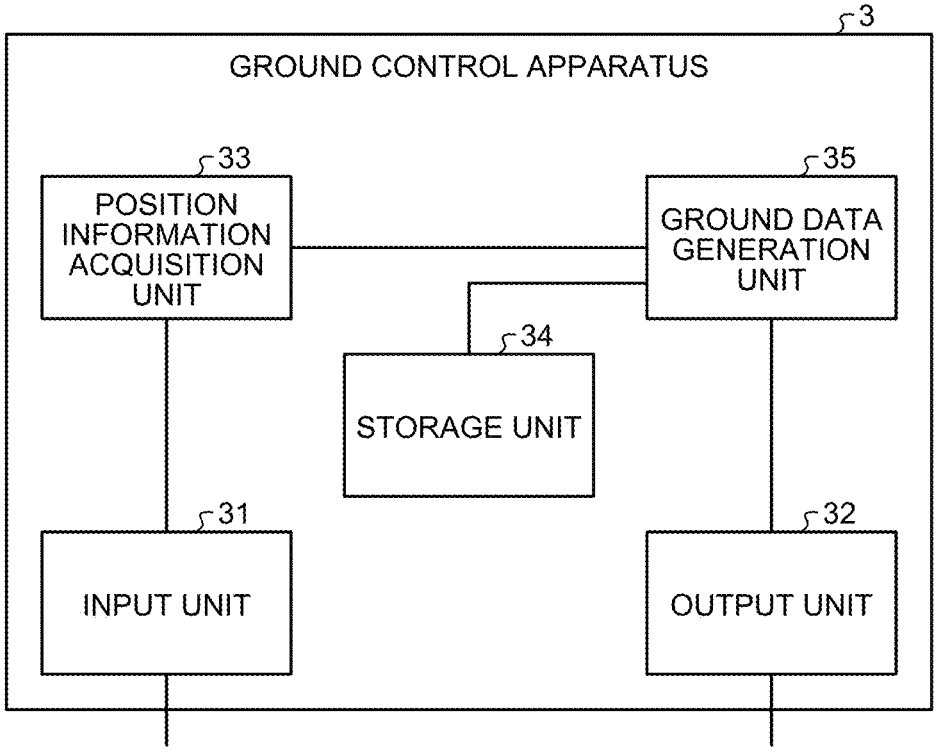
FIG. 6 is a diagram illustrating a configuration of a ground control apparatus according to the first embodiment.

FIG. 6 is a diagram illustrating the ground control apparatus 3 according to the first embodiment. FIG. 6 illustrates only devices required for describing the train control system of the present invention, but other devices and functions may be equipped. The ground control apparatus 3 includes an input unit 31, an output unit 32, a position information acquisition unit 33, a storage unit 34, and a ground data generation unit 35.

The input unit 31 and the output unit 32 are interfaces used to perform communication with the wireless base station 5. On-board data received by the wireless base station 5 from the on-board radio apparatus 62 is inputted to the input unit 31. The output unit 32 outputs train control data generated by the ground control apparatus 3 to the wireless base station 5.

The position information acquisition unit 33 acquires the train position information of the train 6 from the on-board data received by the input unit 31.

The storage unit 34 includes a ground database (not illustrated). Information (track information) on the track 7 in an area managed by the ground control apparatus 3 is stored in the ground database.

The ground data generation unit 35 determines the size of the train control data to be transmitted to the on-board side.

Figure 7:
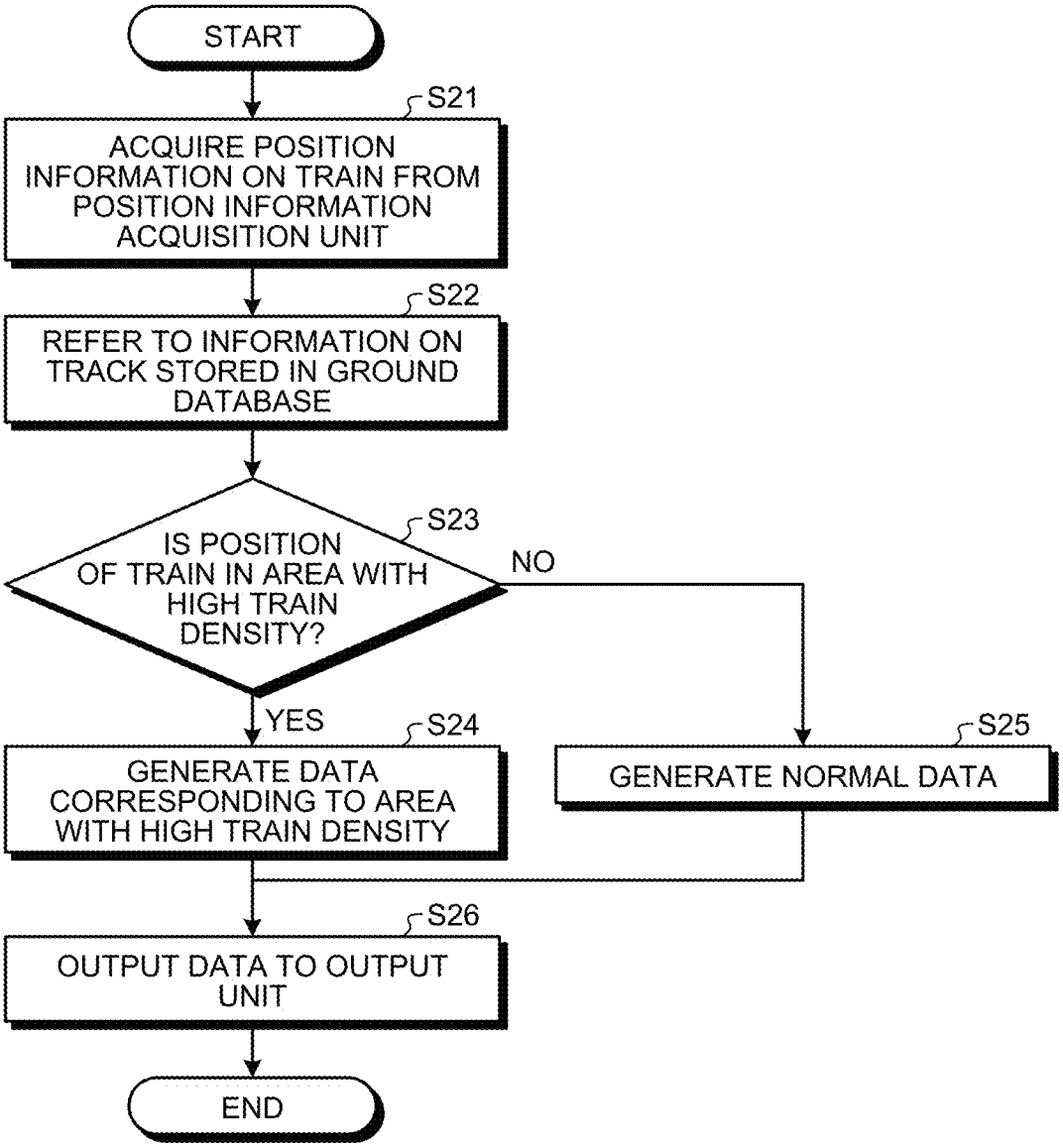
FIG. 7 is a flowchart illustrating an operation of the ground control apparatus according to the first embodiment.

FIG. 7 is a flowchart illustrating an operation of the ground data generation unit 35 included in the ground control apparatus 3 according to the first embodiment. First, the position information (train position information) on the train 6 is acquired from the position information acquisition unit 33 (S21). Next, the information (track information) on the track 7, stored in the ground database of the storage unit 34, is referred to (S22). From the acquired position information of the train 6, it is determined whether or not the train is present on a track in an area with high train density (S23). In a case where the train is present on a track in the area with high train density (S23: Yes), train control data having a data size corresponding to the area with high train density is generated (S24). In the case where the train is present on a track in the normal area (S23: No), train control data having a normal data size is generated (S25). The generated train control data is transmitted to the output unit 32 so as to be outputted toward the on-board control apparatus 68 (S26).

Figure 8A:
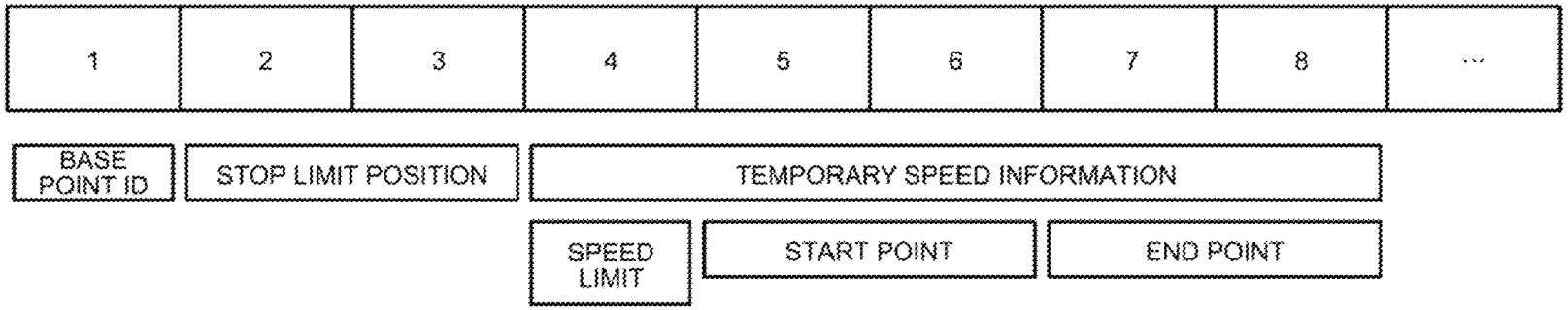
FIG. 8A is a diagram illustrating an example of a data format of train control data generated by the ground control apparatus according to the first embodiment.
Figure 8B:
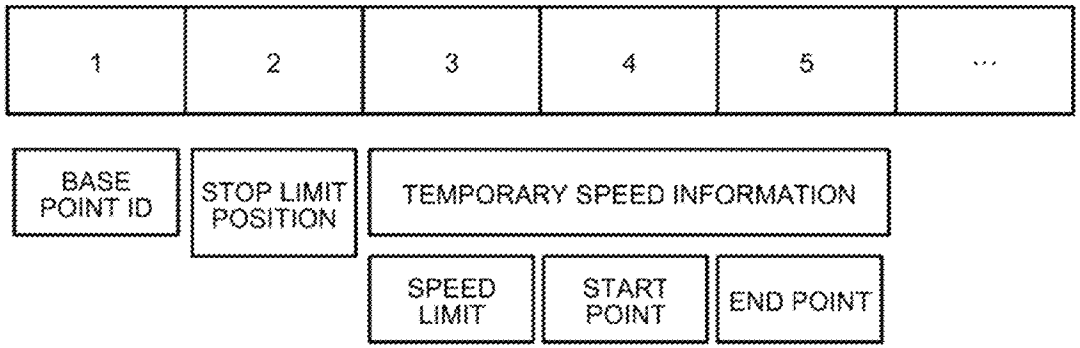
FIG. 8B is a diagram illustrating an example of a data format of train control data generated by the ground control apparatus according to the first embodiment.

FIGS. 8A and 8B are diagrams illustrating an example of a data format of train control data generated by the ground control apparatus 3 according to the first embodiment. This example is based on the assumption that the train control data illustrated in FIGS. 8A and 8B is managed in units of 8 bits (1 byte) similarly to the data illustrated in FIGS. 5A and 5B. FIG. 8A illustrates an example of train control data generated by the ground control apparatus 3 that manages the normal area, and FIG. 8B illustrates an example of train control data generated by the ground control apparatus 3 that manages the area with high train density. The train control data generated by the ground control apparatus 3 includes identification information (base point ID) of the ground control apparatus, stop limit position information, and temporary speed limitation information.

Here, the temporary speed limitation information is information on a temporary speed limit set by the operation management apparatus 1. An example thereof includes a position to start speed limitation, a position to end speed limitation, and information on a speed limit set every 5 km between the start position and the end position.

As illustrated in FIG. 8A, the ground control apparatus 3 that manages the normal area generates train control data of 64 bits in total including the base point ID of 8 bits, the stop limit position information of 16 bits, and the temporary speed limitation information of 40 bits. As illustrated in FIG. 8B, the ground control apparatus 3 that manages the area with high train density generates train control data of 40 bits in total including the base point ID of 8 bits, the stop limit position information of 8 bits, and the temporary speed limitation information of 24 bits. As illustrated in FIG. 8A, in the normal area, the temporary speed limitation information has a data size of 40 bits in total including the speed limitation of 8 bits, a start point of 16 bits, and an end point of 16 bits. On the other hand, as illustrated in FIG. 8B, in the area with high train density, the temporary speed limitation information has a data size of 24 bits in total including the speed limitation of 8 bits, the start point of 8 bits, and the end point of 8 bits.

The data sizes of the stop limit position information and the temporary speed limitation information of the train control data of FIG. 8B are small in comparison with those of the train control data of FIG. 8A. In other words, it is possible to make the data sizes of the stop limit position information and the temporary speed limitation information in the area with high train density to be smaller than those in the normal area.

The stop limit position information will be described. A necessary data size of the stop limit position information depends on a size of a range managed by the ground control apparatus 3 similarly to the above-described train position information. As described above, since the range managed by the ground control apparatus 3 is narrower in the area with high train density than in the normal area, a size of data for management can be reduced in the area with high train density.

The temporary speed limitation information will be described. A necessary data size of the temporary speed limitation information depends on the maximum speed of the train 6 similarly to the above-described train speed information. For example, in many cases, the maximum speed in the normal area is 100 km/h, whereas the maximum speed in the area with high train density such as a railway yard or a station yard of a large station is 20 km/h. When the temporary speed limitation information is set at intervals of 10 km/h, the maximum speed is low in the area with high train density such as a railway yard or a station yard of a large station, and thereby a size of data for management can be made small in the area with high train density.

In the above, the example has been described in which the ground control apparatus 3 uses the train position information and the track information when generating the train control data, but this example can be modified. For example, the train control data may be generated on the basis of the data size of the train position information acquired by the position information acquisition unit 33 of the ground control apparatus 3.

Specifically, when receiving the on-board data illustrated in FIG. 5A from the train 6, the ground control apparatus 3 generates the train control data illustrated in FIG. 8A. When receiving the on-board data illustrated in FIG. 5B from the train 6, the ground control apparatus 3 generates the train control data illustrated in FIG. 8B.

For example, as illustrated in FIG. 5B, when the on-board data generated by the on-board control apparatus 68 of the train 6 has a size smaller than the normal data size, the ground control apparatus 3 determines that the train 6 is present on a track in the area with high train density, and generates train control data having a size smaller than the normal size. On the other hand, when the on-board data generated by the on-board control apparatus 68 of the train 6 has the normal data size, the ground control apparatus 3 determines that the train 6 is present on a track in the normal area and generates the train control data having the normal size. That is, the ground control apparatus 3 may generate, on the basis of a data size of the on-board data generated by the on-board control apparatus 68 of the train 6, instead of using the train position information and the track information, the train control data having a size corresponding to the said data size.

As described above, train control data of 64 bits in the normal area or of 40 bits in the area with high train density is transmitted from the ground control apparatus 3. When the wireless transmission capacity for one wireless base station 5 is 960 bits/sec, the number of trains to which the ground control apparatus 3 can transmit the train control data per second in the normal area is compared with that in the area with high train density. The number of trains to which one wireless base station 5 can transmit the train control data in the normal area is 960/64=15 trains. On the other hand, the number of trains to which one wireless base station 5 can transmit the train control data in the area with high train density is 960/40=24 trains. Therefore, in the train control system according to the first embodiment, the number of trains to which one wireless base station 5 can transmit the data per unit time can be increased.

Figure 9:
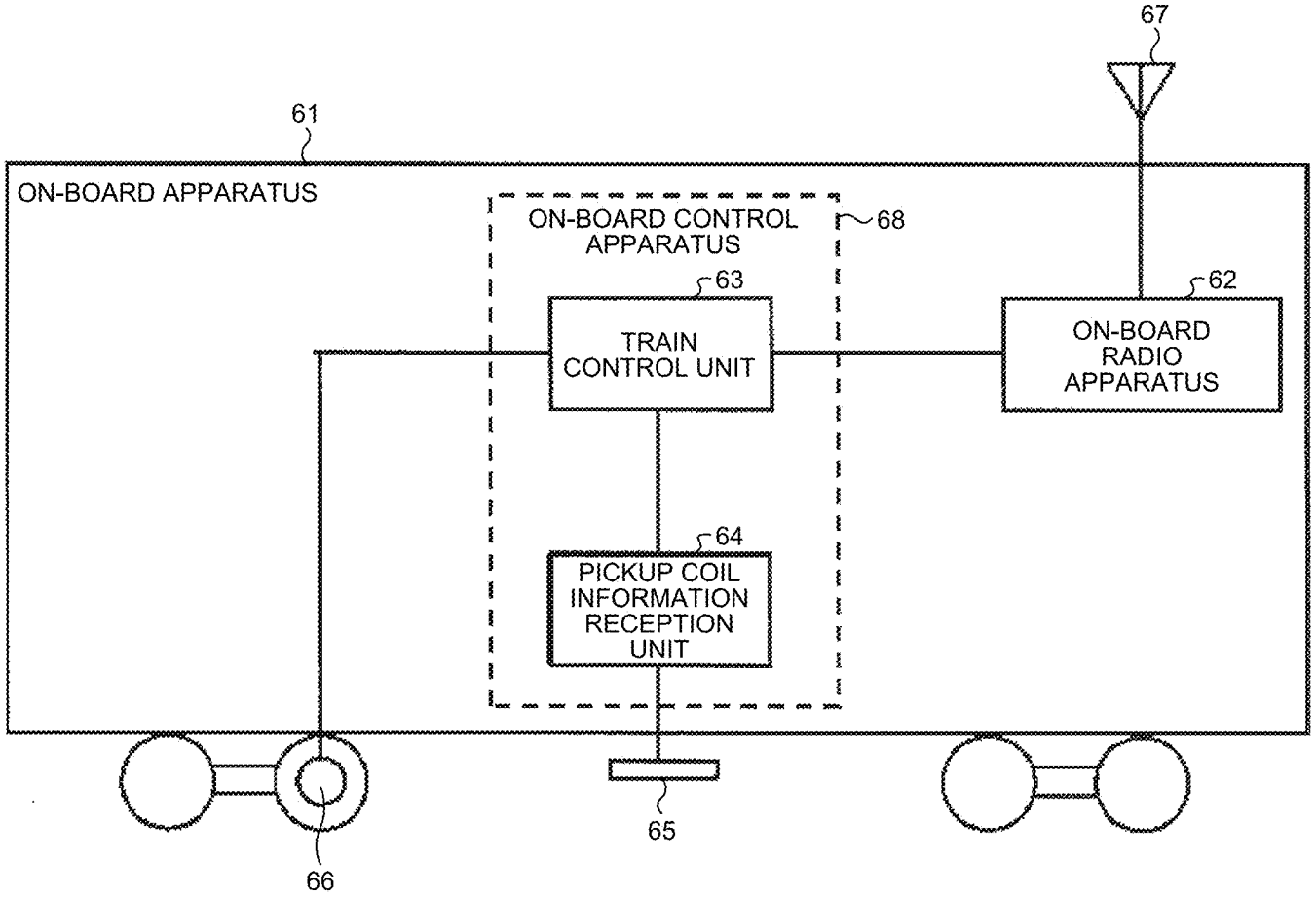
FIG. 9 is a diagram illustrating a configuration of the vehicle according to the first embodiment.

In the first embodiment described above, the configuration including the on-board data generation unit 69 for generating on-board data has been mentioned. However, as illustrated in FIG. 9, the train control unit 63 may have a function of generating on-board data using the track information in the on-board database stored in the storage unit (not illustrated).

Figure 10:
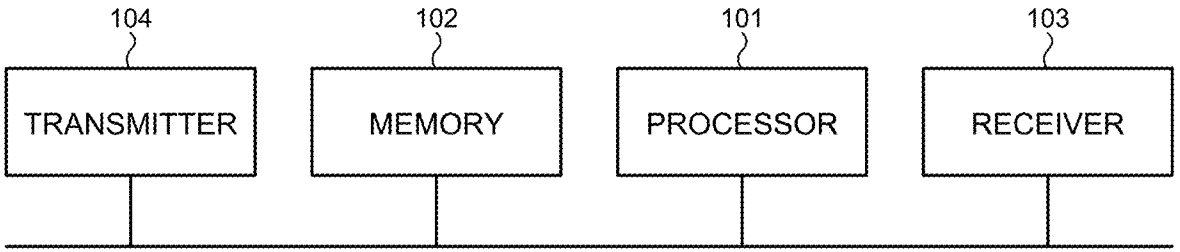
FIG. 10 is a diagram illustrating a typical configuration example of hardware that realizes the ground control apparatus and the on-board control apparatus of the train control system according to the first embodiment.

In the first embodiment described above, the ground control apparatus 3 and the on-board control apparatus 68 include, at least, a processor, a storage circuit, a receiver, and a transmitter, and an operation of each device can be realized by software. FIG. 10 is a diagram illustrating a general configuration example of hardware that realizes the ground control apparatus 3 and the on-board control apparatus 68 of the train control system according to the first embodiment. The apparatus illustrated in FIG. 10 includes a processor 101, a memory 102, a receiver 103, and a transmitter 104. With the use of received data, the processor 101 performs calculation and control based on software. The memory 102 stores the received data or data necessary for the processor 101 to perform calculation and control, and also stores the software. The receiver 103 is an interface that receives a signal or information inputted to the ground control apparatus 3 or the on-board control apparatus 68. The transmitter 104 is an interface that transmits a signal or information outputted from the ground control apparatus 3 or the on-board control apparatus 68. Pluralities of processors 101, memories 102, receivers 103, and transmitters 104 may be provided.

As described above, the train control system according to the first embodiment includes the on-board control apparatus 68 that generates train position information using ground coil position information and train speed information and outputs the train position information, and the ground control apparatus 3 that receives the train position information outputted by the on-board control apparatus 68, identifies a position of the train 6 using the train position information and stored track information, generates train control data having a size corresponding to the identified position of the train 6, and outputs the train control data toward the train 6, and thereby it is possible to generate data having a size corresponding to the train position, so that the number of trains with which one wireless base station 5 can communicate per unit time can be increased.

The ground control apparatus 3 according to the first embodiment receives the train position information outputted from the on-board control apparatus 68 mounted on the train 6, identifies the position of the train 6 using the train position information and the stored track information, generates train control data having a size corresponding to the identified position of the train 6, and outputs the train control data toward the train 6, thereby making it possible to increase the number of trains with which the wireless base station 5 via which the train control data is transmitted to the train 6 can communicate per unit time.

The ground control apparatus 3 according to the first embodiment includes the input unit 31 to which train position information outputted from the on-board control apparatus 68 mounted on the train 6 is inputted, the position information acquisition unit 33 that acquires the train position information inputted to the input unit 31, the storage unit 34 having track information stored therein, the ground data generation unit 35 that identifies the position of the train 6 using the train position information acquired by the position information acquisition unit 33 and the track information stored in the storage unit 34, and generates train control data having a size corresponding to the identified position of the train 6, and the output unit 32 that outputs the train control data generated by the ground data generation unit 35 toward the on-board control apparatus 68, thereby making it possible to increase the number of trains with which the wireless base station 5 via which the train control data is transmitted to the train 6 can communicate per unit time.

When the identified position of the train 6 is within an area with train density equal to or higher than a predetermined reference value, the ground control apparatus 3 according to the first embodiment outputs train control data having a size smaller than that when the position of the train 6 is within an area with train density less than the reference value, thereby making it possible to increase the number of trains with which the wireless base station 5 via which the train control data is transmitted to the train 6 can communicate per unit time.

When the train control data includes the stop limit position information and the identified position of the train 6 is within an area with the train density equal to or higher than the predetermined reference value, the ground control apparatus 3 according to the first embodiment outputs train control data including stop limit position information having a size smaller than that when the position of the train 6 is within an area with train density less than the reference value, thereby making it possible to increase the number of trains with which the wireless base station 5 via which the train control data is transmitted to the train 6 can communicate per unit time.

The on-board control apparatus 68 according to the first embodiment is mounted on the train 6, identifies a position of the train 6 using ground coil position information and train speed information, generates train position information having a size corresponding to the identified position of the train 6, and outputs the train position information to the ground control apparatus 3 that controls an operation of the train 6, thereby making it possible to increase the number of trains with which the wireless base station 5 can communicate per unit time.

The on-board control apparatus 68 according to the first embodiment is provided on the train 6 including the tacho-generator 66 and the pickup coil 65, and includes: the train control unit 63 that calculates the position of the train 6 using the ground coil information transmitted from the ground coil 8 placed on the track along which the train 6 travels and received by the pickup coil 65 and the train speed information detected by the tacho-generator 66, and controls the train 6; the storage unit 70 that has the track information on the track 7 stored therein; and the on-board data generation unit 69 that identifies the position of the train 6 using the position of the train 6 calculated by the train control unit 63 and the track information stored in the storage unit 70, and generates and outputs train position information having a size corresponding to the identified position of the train 6, thereby making it possible to increase the number of trains with which the wireless base station 5 can communicate per unit time.

When the identified position of the train 6 is within an area with the train density equal to or higher than a predetermined reference value, the on-board control apparatus 68 according to the first embodiment outputs train position information having a size smaller than that when the position of the train 6 is within an area with train density less than the reference value, thereby making it possible to increase the number of trains with which the wireless base station 5 can communicate per unit time.

Second Embodiment

Figure 11A:
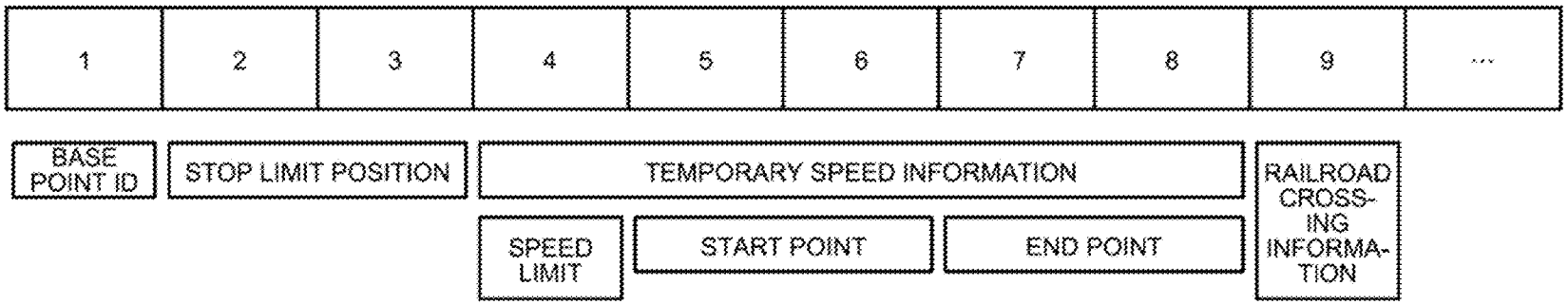
FIG. 11A is a diagram illustrating an example of a data format of train control data generated by the ground control apparatus according to a second embodiment.
Figure 11B:
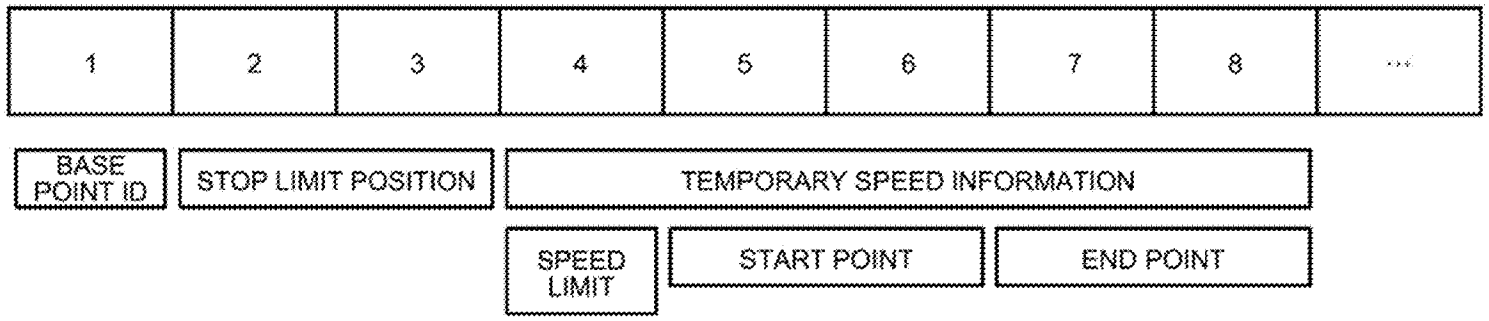
FIG. 11B is a diagram illustrating an example of a data format of train control data generated by the ground control apparatus according to a second embodiment.

FIGS. 11A and 11B are diagrams illustrating an example of a data format of train control data generated by the ground control apparatus 3 according to a second embodiment. In the first embodiment, the train control data to be transmitted to the train 6 present on a track in the normal area and the train control data to be transmitted to the train 6 present on a track in the area with high train density are made equal in type of train control data to be generated, but made different in size thereof. In contrast, in the second embodiment, the train control data to be transmitted to the train 6 present on a track in the normal area and the train control data to be transmitted to the train 6 present on a track in the area with high train density are different in type of train control data to be transmitted, wherein such a type difference is a feature of the second embodiment. The configurations of the devices are equal to those of the first embodiment, except those specifically noted.

Information necessary for monitoring and controlling the trains 6 may be different between the train 6 traveling in an area middle between one station and another station adjacent thereto (inter-station area), and the train 6 traveling in a railway yard. For example, when the train 6 travels in the inter-station area, information on a railroad crossing is required. The information on a railroad crossing includes information on a position of a railroad crossing, information on failure in the railroad crossing, and information on an opening/closing state of a crossing gate of the railroad crossing. In a case where the crossing gate of the railroad crossing is not in a closing state for some reason, or a failure in the railroad crossing occurs, for example, notification of information on such a case from the ground side to the on-board side makes it possible for the train 6 that has received the information to stop before entering the railroad crossing. When the train 6 travels in the inter-station area, the information on a railroad crossing is information necessary for monitoring and controlling the train 6.

On the other hand, when the train 6 travels in the railway yard area, there may be no railroad crossing. In an area where there is no railroad crossing in the railway yard area, the information on a railroad crossing may not be necessary for monitoring and controlling the train 6. For the train 6 traveling in the railway yard area, it is possible to omit the information on a railroad crossing transmitted from the ground side to the on-board side.

FIG. 11A is an example of train control data in the normal area, and FIG. 11B is an example of train control data in the railway yard area. FIG. 11A includes railway crossing information as information on a railway crossing, whereas FIG. 11B does not include railroad crossing information. Since the train control data in the railway yard area does not include the railway crossing information, the data size thereof can be made smaller than that in the normal area.

Figure 12:
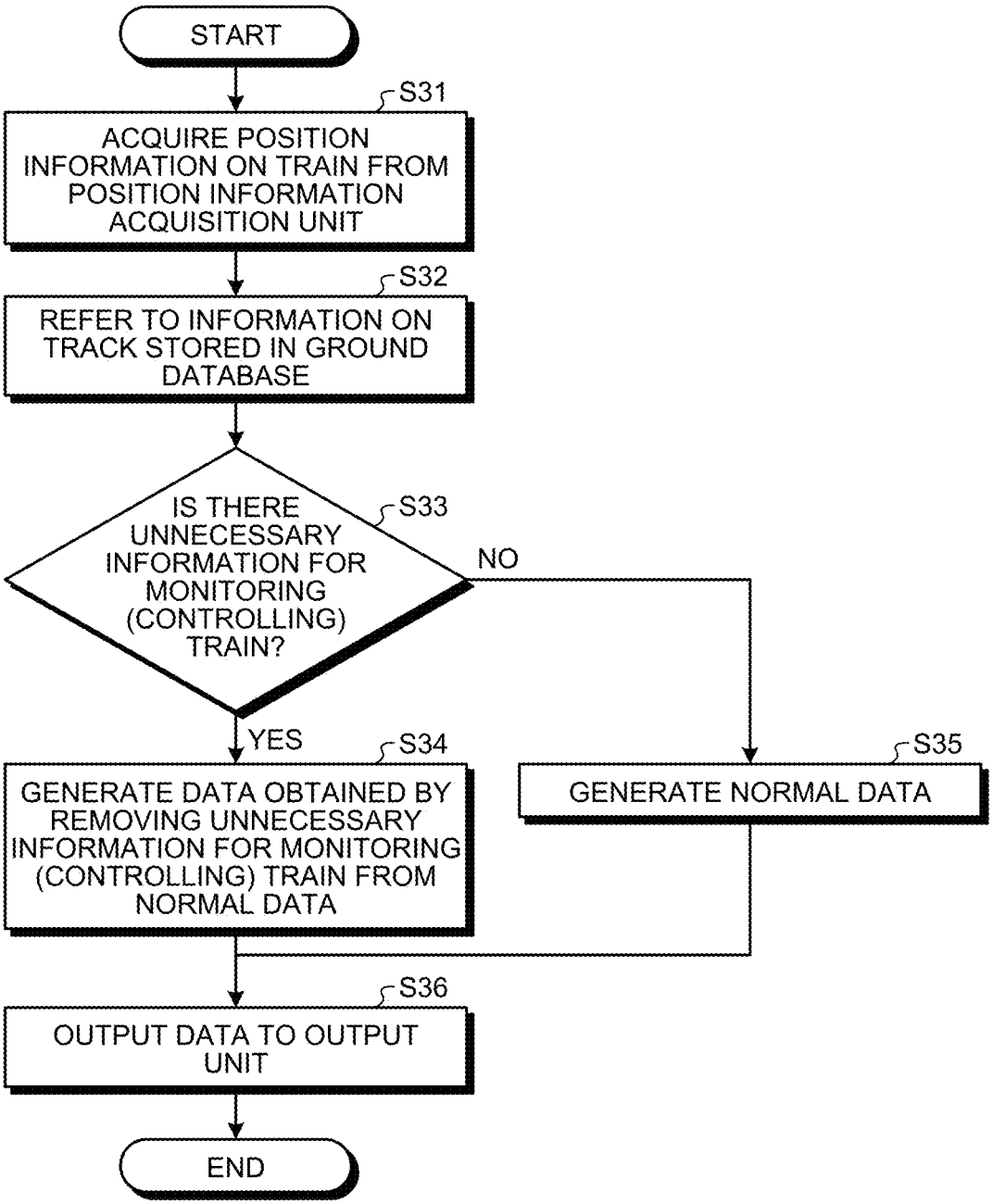
FIG. 12 is a flowchart illustrating an operation of the ground control apparatus according to the second embodiment.

FIG. 12 is a flowchart illustrating an operation of the ground data generation unit 35 included in the ground control apparatus 3 according to the second embodiment. First, the position information on the train 6 is acquired from the position information acquisition unit 33 (S31). Next, the information on the track 7 stored in the ground database is referred to (S32). From the acquired position information on the train 6, it is determined whether or not there is unnecessary information for monitoring (controlling) the train 6 (S33). When it is determined that there is no unnecessary information for monitoring (controlling) the train 6 (S33: No), normal train control data is generated (S34). When it is determined that there is unnecessary information for monitoring (controlling) the train 6 (S33: Yes), train control data obtained by removing data on the unnecessary information from the normal train control data is generated (S35). The generated train control data is outputted to the output unit 32 (S36).

The information unnecessary for monitoring (controlling) the train 6 is information that is not to be used for controlling (monitoring) the train. For example, the above-described railway crossing information is information necessary for controlling (monitoring) the train in the normal area, but is unnecessary information in the railway yard area.

As described above, in the train control system according to the second embodiment, when the position of the train 6 identified by the ground control apparatus 3 is in the railway yard area, the train control data does not include the railroad crossing information, so that the train control data is generated of which size is smaller than that of the train control data generated in the normal area such as an inter-station area, and therefore, the number of trains with which one wireless base station can communicate per unit time can be increased.

In a case where the ground control apparatus 3 according to the second embodiment determines that the train 6 is present on a track in the railway yard area, the railroad crossing information is not included in the train control data, and thereby the ground control apparatus 3 can generate the train control data having a size smaller than that of the train control data generated in the normal area such as an inter-station area, accordingly making it possible to increase the number of trains with which one wireless base station 5 via which this train control data is transmitted to the train 6 can communicate per unit time.

Third Embodiment

Figure 13:
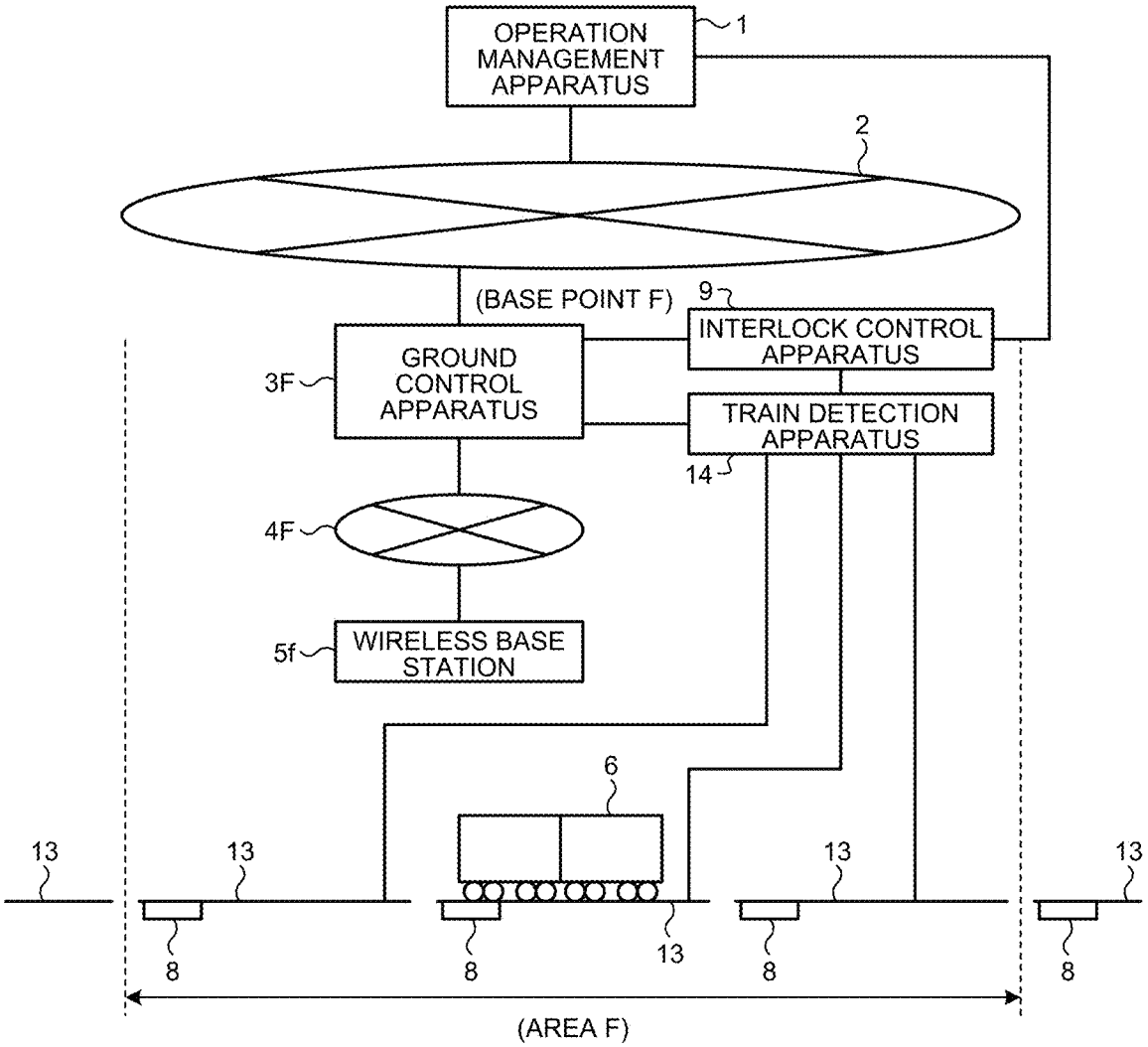
FIG. 13 is a diagram illustrating a schematic configuration of a train control system according to a third embodiment.

FIG. 13 is a configuration diagram of a train control system according to a third embodiment of the present invention. The train control system according to the third embodiment is configured to include a track circuit 13 and a train detection apparatus 14, and other constructional parts are the same as those in the first embodiment. The track circuit 13 is an electrical device that detects the presence of the train 6 in a specific section on the track separated by electrical insulation. For example, in FIG. 13, an area F managed by the ground control apparatus 3 has three track circuits 13.

The train detection apparatus 14 is an apparatus that detects the train 6 on the basis of information indicating the presence or absence of the train 6 on the track from the track circuit 13. A detection result of the train detection apparatus 14 is outputted to the ground control apparatus 3 (3F). On the basis of the detection result of the train detection apparatus 14, the ground control apparatus 3 identifies the position of the train 6 present on the track. The ground control apparatus 3 transmits the identified-position relating information via the train control system network 2 to the operation management apparatus 1, and further to the interlock control apparatus 9.

The interlock control apparatus 9 controls the point machines 11 and the signal devices 10 on the basis of the train position information from the ground control apparatus 3 and a route control instruction from the operation management apparatus 1. In addition, the interlock control apparatus 9 transmits route opening information related to go and stop of the train 6 to the ground control apparatus 3. The interlock control apparatus 9 is connected to the train detection apparatus 14, and thereby interlock control can be performed even when a failure occurs in the ground control apparatus 3. Specifically, the detection result of the train detection apparatus 14 is outputted to the interlock control apparatus 9, thereby making it possible for the operation management apparatus 1 to perform control.

In the storage unit 70 included in the on-board control apparatus 68 of the train control system according to the third embodiment, kilometrage information on a boundary of the track circuit 13 is stored in the on-board database, and accordingly, a block section can be recognized on a side of the train 6.

As described above, the train control system according to the third embodiment includes the track circuit 13 that is provided on the track 7 and outputs on-track presence information on the train 6, and the train detection apparatus 14 that detects the on-track presence information on the train 6 outputted by the track circuit 13, and in the train control system, the ground control apparatus 3 receives a train detection result from the train detection apparatus 14 and identifies the position of the train 6 using the train position information, the track information, and the train detection result, thereby making it possible to accurately recognize the position of the train 6. Therefore, train control data having a size corresponding to the position of the train 6 can be generated, and the number of trains with which one wireless base station 5 via which the train control data is transmitted to the train 6 can communicate per unit time can be increased. In addition, even when a failure occurs in the on-board wireless apparatus 62 on the side of the train 6, it is possible to know that the train 6 is present on the track by the track circuit 13, so that a safer operation can be performed.

REFERENCE SIGNS LIST

1 operation management apparatus;
2 train control system network;
3(3A to 3F) ground control apparatus;
4(4A to 4F) base point network;
5(5A to 5F) wireless base station;
6 train;
7 track;
8 ground coil (position correcting ground coil);
9 interlock control apparatus; 10 signal device;
11 point machine;
12 train station;
13 track circuit;
14 train detection apparatus;
31 input unit;
32 output unit;
33 position information acquisition unit;
34 storage unit;
35 ground data generation unit;
61 on-board apparatus;
62 on-board radio apparatus;
63 train control unit;
64 pickup coil information reception unit;
65 on-board pickup coil;
66 tacho-generator;
67 on-board antenna;
68 on-board control apparatus;
69 on-board data generation unit;
70 storage unit;
101 processor;
102 memory;
103 receiver;
104 transmitter.

The invention claimed is:

1. A train control system comprising:

an on-board control apparatus to generate train position information using ground coil position information and train speed information and to output the train position information; and a ground control apparatus to receive the train position information outputted by the on-board control apparatus, to identify a position of a train using the train position information and stored track information, to generate train control data including stop limit position information having a first pre-allocated bit length corresponding to a first identified position of the train and a second pre-allocated bit length, different from the first pre-allocated bit length, corresponding to a second identified position of the train, and to output the train control data to the train.

2. A ground control apparatus comprising:

an input unit to which train position information outputted from an on-board control apparatus mounted on a train is inputted;

a position information acquisition unit to acquire the train position information inputted to the input unit;

a storage unit having track information stored therein;

a ground data generation unit to identify a position of a train using the train position information acquired by the position information acquisition unit and the track information stored in the storage unit, and to generate train control data including stop limit position information having a first pre-allocated bit length corresponding to a first identified position of the train and a second pre-allocated bit length, different from the first pre-allocated bit length, corresponding to a second identified position of the train; and an output unit to output the train control data generated by the ground data generation unit to an on-board control apparatus.

3. An on-board control apparatus provided in a train including a tacho-generator and a pickup coil, the apparatus comprising:

a train control unit to calculate a position of the train using ground coil information transmitted from a ground coil disposed on a track along which the train travels and received by the pickup coil and train speed information detected by the tacho-generator, and to control the train;

a storage unit having track information on the track stored therein; and an on-board data generation unit to identify the position of the train using the position of the train calculated by the train control unit and the track information stored in the storage unit, and to generate and output train position information having a first pre-allocated bit length corresponding to a first identified position of the train and a second pre-allocated bit length, different from the first pre-allocated bit length, corresponding to a second identified position of the train.

4. The ground control apparatus according to claim 2, wherein when the identified position of the train is within an area with train density equal to or larger than a predetermined reference value, the ground control apparatus outputs the train control data having a pre-allocated bit length smaller than that when the position of the train is within an area with train density less than the predetermined reference value.

5. The ground control apparatus according to claim 2, wherein when the identified position of the train is within an area with train density equal to or larger than a predetermined reference value, the ground control apparatus outputs the train control data that includes the stop limit position information having a pre-allocated bit length smaller than that when the position of the train is within an area with train density less than the predetermined reference value.

6. The on-board control apparatus according to claim 3, wherein when the identified position of the train is within an area with train density equal to or larger than a predetermined reference value, the on-board control apparatus outputs the train position information having a pre-allocated bit length smaller than that when the position of the train is within an area with train density less than the predetermined reference value.

7. The train control system according to claim 1, wherein when the position of the train identified by the ground control apparatus is in a railway yard area, the train control data does not include railroad crossing information.

8. The ground control apparatus according to claim 2, wherein when it is determined that the train is present on a track in a railway yard area, the ground control apparatus does not include railroad crossing information in the train control data.

9. The train control system according to claim 1, comprising:

a track circuit provided on a track, to output on-track presence information on the train; and a train detection apparatus to detect the on-track presence information on the train outputted by the track circuit, wherein the ground control apparatus receives a train detection result from the train detection apparatus and identifies a position of the train using the train position information, the track information, and the train detection result.

10. The train control system according to claim 7, comprising:

a track circuit provided on a track, to output on-track presence information on the train; and a train detection apparatus to detect the on-track presence information on the train outputted by the track circuit, wherein the ground control apparatus receives a train detection result from the train detection apparatus and identifies the position of the train using the train position information, the track information, and the train detection result.

* * * * *